United States Patent [19]

Willis

[11] 4,325,682

[45] Apr. 20, 1982

[54] APPARATUS FOR DISCHARGING MATERIAL

[75] Inventor: Frank M. Willis, Wenonah, N.J.

[73] Assignee: E. I. Du Pont de Nemours and Company, Wilmington, Del.

[21] Appl. No.: 102,903

[22] Filed: Dec. 12, 1979

[51] Int. Cl.[3] ..... F04C 2/107; F04C 5/00; F04C 13/00

[52] U.S. Cl. ..... 418/48; 418/182; 222/381; 222/383

[58] Field of Search ..... 418/1, 48, 182; 222/378, 381, 383; 86/20 R

[56] References Cited

U.S. PATENT DOCUMENTS

| | | | |
|---|---|---|---|
| Re. 24,079 | 10/1955 | Mateer | 418/48 |
| Re. 29,626 | 5/1978 | Allen | 418/48 |
| 1,892,217 | 12/1932 | Moineau | 418/48 |
| 2,028,407 | 1/1935 | Moineau | 418/48 |
| 2,483,370 | 9/1949 | Moineau | 418/48 |
| 2,612,845 | 10/1952 | Byram et al. | 418/48 |
| 2,826,152 | 3/1958 | Michie | 418/48 |
| 2,879,920 | 3/1959 | Davies | 418/48 |
| 2,957,427 | 10/1960 | O'Connor | 418/48 |
| 3,165,065 | 1/1965 | Stickel | 418/48 |
| 3,567,348 | 3/1971 | Benson | 418/48 |
| 3,600,113 | 8/1971 | Pahl et al. | 418/48 |
| 3,612,734 | 10/1971 | Dawson et al. | 418/48 |
| 3,930,765 | 1/1976 | Waite | 418/48 |
| 3,932,072 | 1/1976 | Clark | 418/48 |
| 4,029,443 | 6/1977 | Burnside et al. | 418/48 |
| 4,080,115 | 3/1978 | Sims et al. | 418/48 |

FOREIGN PATENT DOCUMENTS

| | | | |
|---|---|---|---|
| 561386 | 10/1957 | Belgium | 418/48 |
| 1906312 | 11/1969 | Fed. Rep. of Germany | 418/48 |
| 1346417 | 11/1963 | France | 418/48 |

OTHER PUBLICATIONS

*Ramoy Pumps*, catalog, Route 1 North, Columbia, SC 29204, Apr. 1979.

*Primary Examiner*—John J. Vrablik

[57] ABSTRACT

A progressing cavity pump having a rotor (13) which rotates and orbits within a stator (14) is provided with the stator (14) being connected at one end to a hopper (12) containing the material being dispensed by a flexible tube (26) and to a fixed joint (29) at its other end. This fixed joint (29) and a flexible joint (21) connecting the rotor (13) to a rotary drive means (20) are positioned outside the material, for easy observation; together with the flexible tube (26) such joints permit the rotor (13) to rotate and to orbit conically about the flexible joint (22) and the stator to orbit conically about the fixed joint (29), 180° out of phase with the rotor.

The apparatus is particular suited to handle a water gel explosive which might create a safety hazard if the explosive enters a joint without detection.

10 Claims, 3 Drawing Figures

APPARATUS FOR DISCHARGING MATERIAL

TECHNICAL FIELD

This invention is an apparatus for and a method of discharging material from a hopper using a progressing cavity pump having an orbitable rotor which is rotatable within an orbitable stator fixed against rotation. One end of the stator is connected to the hopper by a flexible tube and the other end to a fixed joint (i.e., a flexible joint fixed against rotation); the rotor is connected to a rotary drive means through a flexible joint. These two joints, which are both positioned outside the material to be discharged, together with the flexible tube allow the parts to move as required. The apparatus is useful for discharging viscous material, such as a liquid explosive, from a hopper.

BACKGROUND ART

It is known, in the prior art, to use a progressing cavity type pump in which a rotor rotates within a stator to discharge material from a hopper or other supply source. Prior to this invention, however, the art had found no way to discharge material using such a pump without having one or more of the flexible joints connecting the rotor to an appropriate drive means immersed in the material being discharged.

A typical progressing cavity pump is shown in U.S. Pat. No. 1,892,217 to Moineau; another pump of this type is shown in U.S. Pat. No. 2,483,370, also to Moineau.

Basically these pumps include a stator having an inner double helically threaded surface and a helical rotor having a constant diameter circular cross section positioned within the stator. The rotor is adapted to rotate eccentrically within the stator, when driven by an appropriate drive means, through a flexible joint, and as the rotor rotates and orbits, it generates progressing cavities which deliver the material to the discharge point.

Means to accommodate the eccentric orbiting or wobbling of the rotor must be provided. Many solutions are known to the art. The commonest is a set of universal joints of the Cardan type to provide two spaced pivotal connections, as disclosed in U.S. Pat. No. 2,028,407 to Moineau. These universal joints allow the rotor to orbit; the stator is fixed. Other types of universal joints may be used, such as the cross-slide shown in U.S. Pat. No. 3,567,348 to Benson. Another solution is a flexible one-piece shaft also as shown in U.S. Pat. No. 2,028,407 to Moineau, U.S. Pat. No. 3,600,113 to Pahl, or U.S. Pat. No. 3,612,734 to Dawson et al., for example. It further has been proposed to rotate the outer member of the pump as in U.S. Pat. No. 3,932,072 to Clark. The inner member then is constrained to wobble; one end is free, and the other is prevented from rotating but may pivot about a point which is permitted to reciprocate.

Two types of stators are known to the art. Moderate to high pressure pumps may employ tube or rigid stators. The double helical surface in such instances is formed in a rigid material or in a resilient or elastomeric material encased in a rigid tube. Low to moderate pressure pumps have the stator fully molded in a resilient material. These frequently are called wobble stators and are further described in a "Ramoy Pumps" catalog, dated April 1979.

Two forms of these latter pumps exist. In one, the rotor has no wobbling motion; the stator wobbles or gyrates, sweeping out a cylindrical orbit. In the other, as shown at pages 6, 8, 9, 10, 11 and 12 of the "Ramoy Pumps" catalog, for example, the rotor is connected to the drive means through a flexible joint positioned in the flow path of the material being discharged and wobbles in a conical orbit with its apex at that joint. The stator, on the other hand, is constrained in a manner whereby it orbits in a conical orbit which has its apex on the centerline of the stator extended to an imaginary point. The cone swept out by the stator is inverted relative to the cone swept out by the rotor.

In many industrial situations, it is particularly convenient to discharge a hopper from the bottom and where the material is viscous or must be metered, it is common to mount a pump on the bottom discharge outlet of such hopper. Often it is necessary to drive such a pump from above with the drive train including the required universal joint extending through and in the pumpable fluid.

Such as arrangement is shown in U.S. Pat. No. Re. 24,079 to Mateer. One or both of the requisite universal joints, which provide the rotatable pivotal connections needed to accommodate the eccentric or orbiting motion of the rotor is submerged in the pumpable fluid. These joints are shielded from the fluid by means of boots of fluid-resistant flexible material in those instances where it is necessary to prevent the fluid from getting inside the joint. This shielding is mandatory when an explosive material such as water gel or other liquid explosive is pumped.

Further, when pumping a liquid explosive, it is imperative to avoid shaft seals in the pump wetted by the liquid. It is equally important to avoid dead spaces within the pump. Thus the pumps previously describe in the "Ramoy Pumps" catalog are not adaptable to this use and a drive design such as the one shown in Mateer is used. The submerged boot protecting the universal joint, however, may fail in service and since it cannot be seen by the operator, such an occurrence would permit explosive to enter the joint itself with the possibility of an explosion.

This invention solves these problems by positioning the flexible joint connecting the rotor to the rotary drive means above, and outside, the material in the hopper and by connecting one end of the stator to a fixed joint positioned below, and outside, the material and the other end to a flexible tube surrounding the discharge outlet of the hopper. The flexible joint permits the orbitable and rotatable motion required of the rotor while the fixed joint and flexible tube permit the orbitable motion required of the stator. And this is done while eliminating the submerged joints and shaft seals of pumps, as shown in the prior art.

Accordingly, prior to this invention, there was a need for a progressing cavity pump for discharging material, such as explosive water gel or other viscous material, from a hopper without requiring the mechanical joints connecting the operating parts of the apparatus to each other be immersed in the material being discharged, while still permitting the unique motion required of the stator and the rotor. This invention, in solving this problem, and problems brought about by mechanical shaft seals, for example, provides such a pump and in doing so gives to the material handling art improvements heretofore not known to such art.

SUMMARY OF THE INVENTION

Briefly described, this invention is an apparatus for discharging material from a supply source. It is particularly useful in discharging a hopper of a fluid explosive.

Such apparatus, basically, is an improved progressing cavity pump and includes an orbitable stator connected at one end to the hopper by a connecting means and an orbitable and rotatable rotor operatively connected to the stator and driven through a flexible joint positioned above the material. The other end of the stator is connected to a fixed joint positioned below the material and the connecting means is made of a flexible material. These joints and this flexible connection permit the rotor and stator to orbit upon rotation of the rotor.

This invention further is an improvement in an apparatus for discharging material from a hopper which includes a progressing cavity pump having a rotor operatively connected to a stator having its centerline parallel to the rotor centerline, the rotor being connected to rotary drive means and the apparatus having means to prevent rotation of the stator. In improving this apparatus the stator is connected to a fixed joint which is pivotable whereby upon activation of the rotary drive means the rotor rotates about the rotor centerline and orbits in a conical orbit having an apex located on the rotor centerline, and the stator orbits in a conical orbit having an apex located on the stator centerline.

In this apparatus the rotor is connected to the rotary drive means through a flexible joint which is pivotable and rotatable and the stator is connected to the hopper by a connecting means made of a flexible material. Further in such apparatus the fixed joint is provided with means to prevent rotation of the stator at such fixed joint and the apex of the conical orbit in which the stator orbits is located at this fixed joint. Importantly, the centerlines of the rotor and the stator are enclosed within the flexible connecting means which connects the stator to the hopper. Preferably this connecting means is in the form of a tube.

In a further embodiment, this invention is an apparatus for discharging material from a hopper comprising:

a stator, a rotor operatively connected to the stator, a rotary drive means operatively connected to the rotor by a first connecting means, the stator being connected at one end to the hopper by a second connecting means and at its other end to a fixed point by a third connecting means, whereby upon activation of the rotary drive means the rotor rotates within the stator and orbits about the first connecting means, and the stator orbits about the third connecting means.

In this apparatus just described, the first connecting means and the third connecting means are both positioned outside the material being discharged.

Further this invention is an improvement in an apparatus for discharging material from a hopper and including a progressing cavity pump having a screw rotor and a screw stator having a centerline parallel to the rotor centerline, the rotor being connected to rotary drive means and the apparatus having means to connect the stator to the hopper and means to prevent rotation thereof. The means to connect the stator to the hopper in this improved apparatus is a flexible tube and the means to prevent rotation of the stator includes this flexible tube together with a pivotable joint having means to prevent rotation of the stator at this joint.

Still further this invention is an apparatus for discharging material including:

a hopper having an outlet and containing the material to be discharged, a pump including an orbitable, non-rotatable stator and an orbitable, rotatable rotor operatively connected together, the stator having a centerline and being connected at one end to the outlet of the hopper by a flexible tube and at its other end to a pivotable joint having means to prevent rotation of the stator thereabout, drive means connected to the rotor, the rotor having a centerline parallel to the stator centerline and being connected to the drive means by a rotatable, pivotable joint, whereby upon activation of the drive means the rotor rotates about the rotor centerline and orbits in a conical orbit having an apex located on the rotor centerline, the stator orbits in conical orbit having an apex located on the stator centerline, and the centerlines are enclosed within the flexible tube.

In this apparatus and rotatable, pivotable joint connecting the drive means to the rotor and the pivotable non-rotatable joint to which the stator is connected are both positioned outside the material being discharged.

Lastly this invention is a method of discharging material using a progressing cavity pump including a rotor operatively connected to a stator, and including the steps of:

rotating the rotor whereby it orbits apically about a first point and the stator orbits apically about a second point, while preventing rotation of the stator.

This invention, as one example, solves problems existent in the prior art in which the flexible joint or joints connecting the rotor to the drive means were immersed in the material being discharged. In discharging fluid or water gel explosives in particular this submerged joint or coupling is considered a potential safety hazard.

This invention eliminates this submerged coupling or joint by allowing the stator, which is mounted on the outside of the hopper by a flexible tube to orbit conically about a fixed non-rotating pivot or joint positioned below the material and the rotor to orbit conically about another non-submerged, rotating pivot or joint positioned above the material.

DESCRIPTION OF A PREFERRED EMBODIMENT

This invention is an apparatus for and method of discharging material from a supply source. In a preferred embodiment such apparatus and method are useful in discharging a water gel explosive from a hopper.

Figure 1:
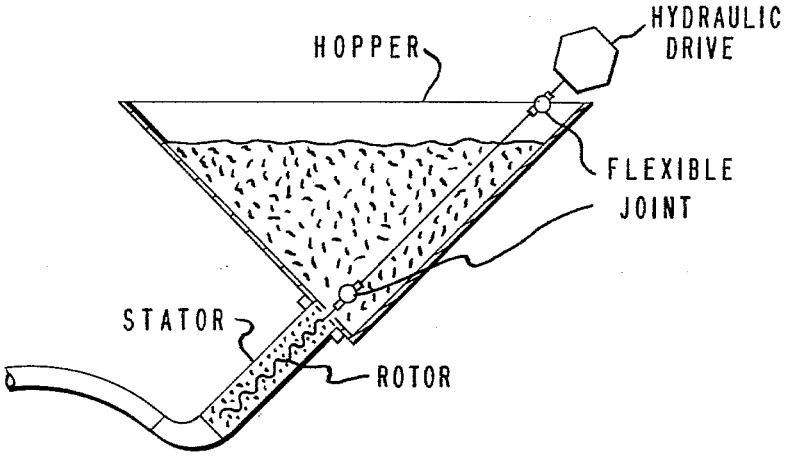
FIG. 1 PRIOR ART
FIG. 1 is a schematic, cross-sectional view of a typical prior art progressing cavity pump in which a rotor operatively positioned within a stator is driven through flexible joints, at least one of which is immersed in the material being discharged.
Figure 2:
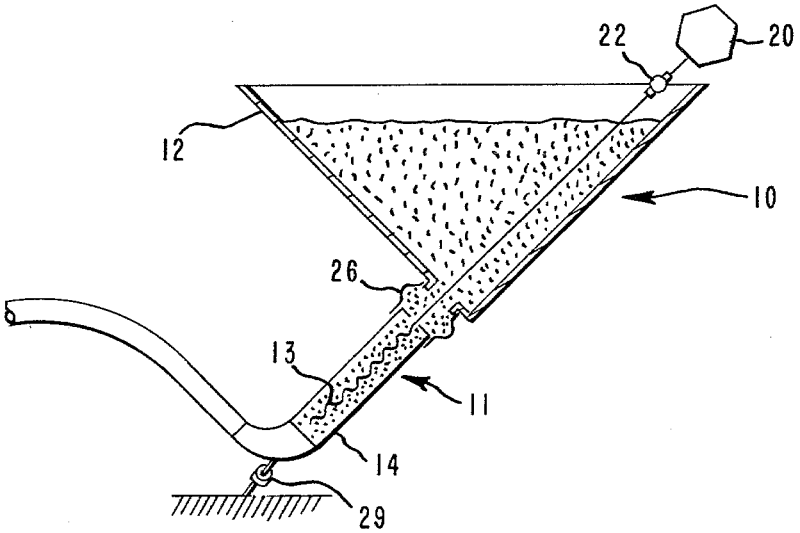
FIG. 2 is a schematic, cross-sectional view of an apparatus of this invention which includes a progressing cavity pump in which the stator is connected to a fixed joint and the rotor is driven through a flexible joint, both of which joints are positioned outside the material being discharged.
Figure 3:
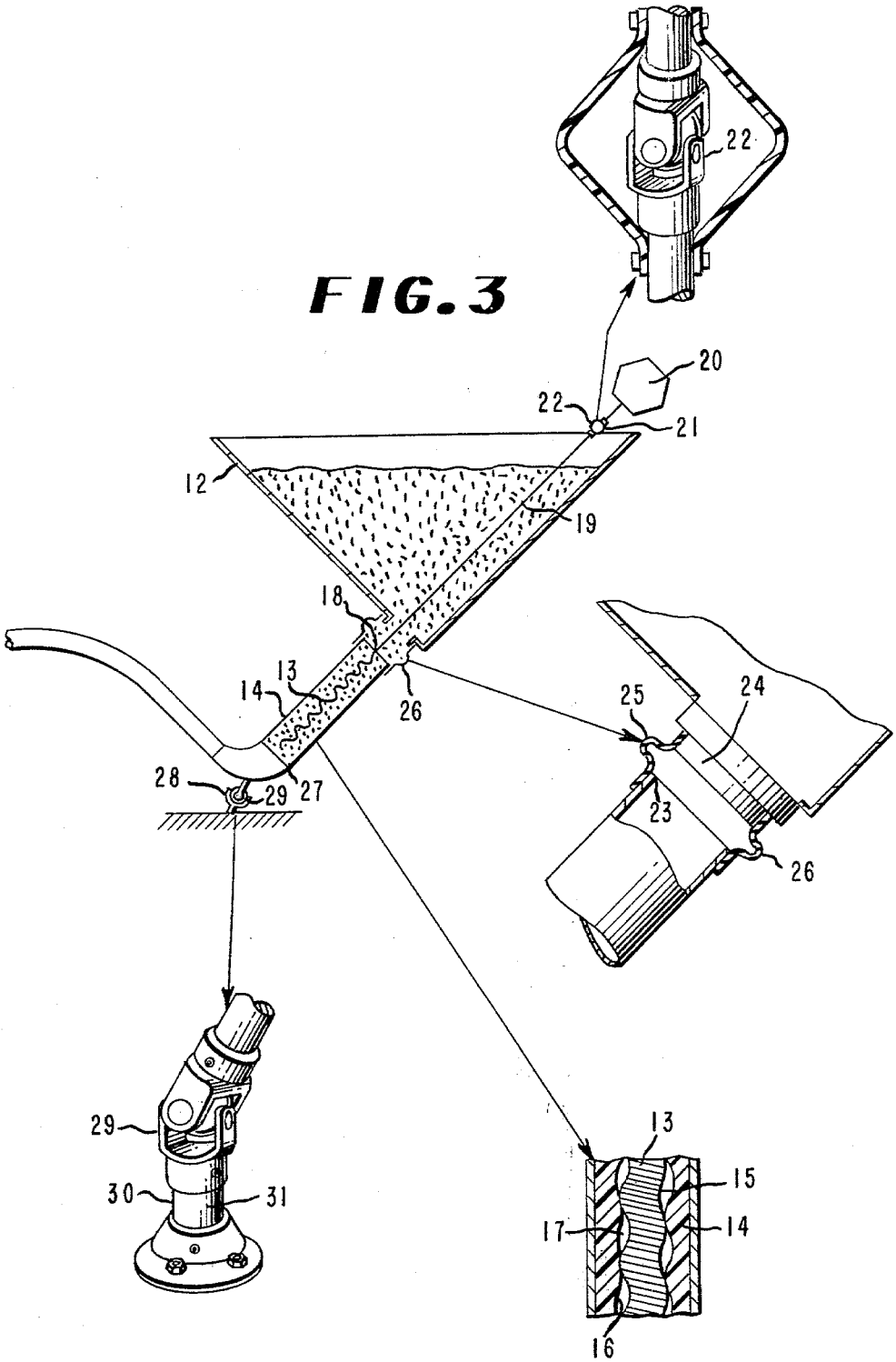
FIG. 3 is a schematic, cross-sectional view of the apparatus of FIG. 2, showing the parts in greater detail.

Referring to the drawings, an apparatus of this invention, generally designated 10, is shown in FIGS. 2 and 3. Such apparatus 10, in the main, is in the form of a progressing cavity pump, generally designated 11, which is connected to a hopper 12 containing the material to be discharged, by appropriate means further to be described.

The apparatus 10 is particularly suited for discharging a hopper of a water gel explosive. This material is difficult and dangerous to handle and should it enter a working joint could cause an explosion. For this reason it is necessary constantly to check these joints, which usually are booted or covered, to make certain there is no problem occurring, and that none of the material is entering the joint, due to undetected wear of the covering material.

The pump 11 essentially comprises a rotor 13 operatively connected to a stator 14, driven by an appropriate means. The rotor 13 has a true helical threaded outer surface 15 and the stator has a double helically threaded inner surface 16 defining passageway 17 into which the rotor 13 is positioned. The stator 14 has one more thread than the rotor 13, so that when the rotor 13 rotates within the passageway 17 it generates progressing small cavities which deliver the material to a discharge point.

The rotor, in progressing cavity pumps, including the pump of this invention, is adapted to both orbit and rotate within the stator in an eccentric motion. Such rotor 13, in the embodiment shown, is connected at one end 18, through a straight shaft 19 to a rotary drive means 20 by a first connecting means 21, preferably in the form of a flexible joint 22, positioned above the material being dispensed, where it readily may be checked for wear. The stator 14 is connected at one end 23 to the hopper 12 at an outlet 24 thereof by a second connecting means 25, preferably in the form of a flexible tube 26 and at its other end 27 to a third connecting means 28, preferably in the form of a fixed joint 29, positioned below the material to be dispensed, whereby it, too, readily may be checked for wear.

The flexible joint 22 is preferably a double universal joint which allows the rotor both to rotate and orbit and the fixed joint 29 is connected to ground and is provided with means 30, in the form of a stub shaft 31, to prevent rotation of the stator 14 about this joint 29. The flexiblwe tube 26 which connects the other end of the stator 14 to the hopper 12 also prevents rotation of the stator 14, while permitting it to orbit about the fixed joint 29 apically. In short, the flexible joint 22, the fixed joint 29 and the flexible tube 26 provide means whereby upon activation of the rotary drive means, the rotor 13 orbits and rotates and the stator 14 only orbits, as required to discharge material from the hopper 12.

To be more specific, in this apparatus 10 the rotor 13 and stator 14 centerlines are parallel to each other and upon activation of the rotary drive means 20, the rotor 13 rotates about the rotor centerline and orbits in a conical orbit having an apex located on the rotor centerline, and the stator 14 orbits in conical orbit having an apex located on the stator centerline, the orbits being 180° out of phase which is to say the centerlines are on opposite sides of a line connecting the two apices. It is important that these centerlines are both enclosed within the flexible tube 26 connecting the stator 14 to the hopper 12, for reasons further to be explained.

Stated another way, in this apparatus the rotor 13 is connected to the rotary drive means 20 through the flexible joint 22 which is pivotable and rotatable and the stator 14 is connected to the hopper 12 by connecting means 25 which is made of a flexible material. Further in such apparatus the fixed joint 29 is provided with means to prevent rotation of the stator 14 at such fixed joint 29 and the apex of the conical orbit in which the stator 14 orbits is located at this fixed joint 29. Importantly, the centerlines of the rotor 13 and the stator 14 are enclosed within the flexible connecting means 25 which connects the stator 14 to the hopper 12. Preferably this connecting means is in the form of a tube 26.

The material of the tube 26 for connecting the stator 14 to the hopper 12 is flexible; it has give and must be capable of recovering its size and shape after deformation. It differs from the material of the flexible joint 22 connection previously described in which non-resilient parts of proper, non-deformable, shape and size are used to permit the rotor 13 and stator 14 to move relative thereto, as required. Preferably, the tube 26 for connecting the stator 14 to the hopper 12 is of a U-shaped configuration, as shown; it is available for purchase from Pathway Bellows, Inc. under the tradename "Spanflex" rubber expansion joint.

The stator 14 of this invention as previously described in the last paragraph on page 2, and as shown in the drawing is a "rigid" stator of the type employed in high pressure pumps. Stated another way, the term "rigid" stator as used in this application means the stator is formed of rigid material, such as metal, as shown in Mateer U.S. Pat. No. Re. 24,079, which has been incorporated by reference in this application or of a resilient material encased in (i.e., affixed to or serving as a lining of) a rigid tube. In either case the stator is not flexible, as that word is used in this application, but is instead "rigid" and comprised in whole or in part of a hard, non-flexible material so as to enable it to operate in high pressure uses.

Preferably the stator 14 is lined with an elastomeric material. By connecting the stator to the hopper 12 by means of the flexible tube 26 and by permitting the stator to orbit about the fixed joint 29 both dynamic imbalance and wear on the stator 14 is reduced, as compared to the progressing cavity pump as shown in U.S. Pat. No. Re. 24,079 to Mateer, for example, wherein the stator is fixed to the hopper.

The flexible tube 26 used to connect the stator 14 to the hopper 12 preferably is made of nitrile butadiene rubber when the material being handled is a water gel explosive, because of its compatability with such explosive.

In the prior art, the flexible joints of the pump are covered to prevent material from entering the joint. The covers are flexible and may be filled with lubricant. Should these covers become worn particularly in the case of the submerged joint and permit explosive to enter the joint, an explosion could occur. By moving this submerged joint to a location where it may be observed this problem is eliminated.

Preferably the flexible joint 22 through which the rotor 13 is driven in accordance with this invention is covered although it is not in contact with the material being discharged. A suitable joint is a universal joint available from Apex Machine and Tool Co. of Dayton, Ohio.

Preferably the fixed joint 29 also is a covered universal joint of the type just described but is mounted on a fixed stub shaft 31 to prevent rotation of the stator 14 at or about this joint 29.

For purposes of this disclosure, elastic implies the property of resisting deformation by stretching; resilient implies the ability to recover shape quickly when the deforming force or pressure is removed; springy is used to stress both the ease with which something yields to pressure and the quickness of its return to original shape; flexible applies to something which may or may not be resilient or elastic but which can be bent or folded without breaking; supple applies to something that can be readily bent, twisted, or folded without any sign of injury.

The main parts of the progressing cavity pump of this invention, including the rotor 13 and stator 14, the flexible joint 22 and rotary drive means 20 are known to the art. For example, a suitable pump (stator, rotor, universal joint, and drive means, for example) for practicing this invention are shown in U.S. Pat. No. Re. 24,079 to Mateer and in various other patents including U.S. Pat. No. 1,892,217 to Moineau, the teachings of which patents are incorporated by reference herein. The other parts of the apparatus of this invention including the flexible tube 26 connecting the stator 14 to the hopper 12 and the fixed joint 29, which has means to prevent the stator 14 from rotating while permitting orbiting, have been described hereinabove.

Lastly, this invention is a method of discharging material using a progressing cavity pump including a rotor 13 operatively connected to a stator 14, and including the steps of:

rotating the rotor 13 whereby it orbits apically about a first point and the stator 14 orbits apically about a second fixed point, while preventing rotation of the stator 14 about this second point.

In a preferred method for discharging a hopper of viscous material, particularly in those instances where the material is metered, it is common to discharge the material through an outlet in the bottom of the hopper and to drive the rotor from above the material with the drive shaft extending in and through the material, as shown in U.S. Pat. No. Re. 24,079, for example. The drive train is in-line and the centerlines of the stator and rotor, which are parallel, extend in and through the outlet. This eliminates the need for any shaft seals.

This also is true of the instant invention wherein in a preferred apparatus the centerlines of the rotor 13 and stator 14 are always within the flexible tube 26 surrounding the outlet 24 in the hopper 12. This is important in that it, too, eliminates the need for submerged shaft seals and, as previously mentioned, this can present a safety hazard when handling material such as a water gel explosive. And with any type material if it enters the joint undetected, working or functioning problems may occur with the apparatus.

This is not the case in certain progressing cavity pumps of the prior art, such as the so-called wobble stator pump previously described, where the centerlines of the rotor and stator are parallel to each other but do not extend through the outlet. Thus a mechanical seal or shaft seal is required at or adjacent the discharge point or outlet to make the apparatus workable. This seal is submerged in the material being discharged and being hidden from view creates the very problem this invention solves.

As shown and described, the apparatus of this invention solves the problems of the prior art by connecting the parts of the drive train in line and by positioning the flexible joint 22 connecting the rotor 13 to the rotary drive means 20 above, and outside, the material in the hopper 12 and by connecting one end of the stator 14 to the fixed joint 29 positioned below, and outside, the material and the other end to a flexible tube 26 surrounding the discharge outlet 24 of the hopper 12. The flexible joint 22 permits the orbitable and rotatable or pivotable motion required of the rotor 13 while the fixed joint 29 and flexible tube 26 permit the orbitable motion required of the stator 14. Further the centerlines of the parts are in line and extend through the flexible tube 26. And this is done while eliminating the submerged joints and shaft seals of pumps, of the prior art.

Accordingly, prior to this invention, there was a need for a progressing cavity pump for discharging material, such as explosive water gel or other viscous material, from a hopper without requiring the mechanical joints connecting the operating parts of the apparatus to each other be immersed in the material being discharged, while still permitting the unique motion required of the stator and the rotor. This invention, in solving this problem, and problems brought about by mechanical shaft seals, for example, provides such an apparatus.

A BEST MODE FOR CARRYING OUT THE INVENTION

A best mode for carrying out the invention may be practiced by referring to FIG. 3, which shows a preferred apparatus of this invention, and by following the foregoing description.

INDUSTRIAL APPLICABILITY

Among the ways this invention is capable of exploitation in industry is that it gives to the art a method and apparatus heretofore not available to it, that being, an apparatus and method for discharging material, such as a liquid explosive, from a hopper, while being able constantly to detect any potential problems created by material entering a working joint and correcting any such defect that may be observed.

I claim:

1. A progressing cavity pump for discharging material from a hopper including an orbitable rigid stator connected to the hopper by a connecting means made of a flexible material and an orbitable and rotatable rotor driven through a flexible joint positioned above the material to be discharged.

2. The pump of claim 1 wherein said stator is also connected to a fixed joint positioned below the material, said joint being pivotable and having means to prevent rotation of the stator thereabout.

3. An apparatus for discharging material including:

a hopper having an outlet and containing the material to be discharged a progressing cavity pump including a rigid stator connected to the outside of said hopper at the outlet by a connecting means made of a flexible material and a rotor operatively connected to said stator and driven through a flexible joint positioned above the material.

4. In an apparatus for discharging material from a hopper and including a progressing cavity pump having a rotor having a centerline, said rotor being operatively connected to a rigid stator having a centerline parallel to the rotor centerline, said rotor being connected to rotary drive means and the apparatus having means to prevent rotation of said stator, the improvement wherein said stator is connected to a fixed joint which is pivotable and has means to prevent rotation of said stator at said fixed joint whereby upon activation of the rotary drive means said rotor rotates about the rotor centerline and orbits in a conical orbit having an apex located on the rotor centerline, and said stator orbits in a conical orbit having an apex located on the stator centerline, wherein one end of said stator is connected to the hopper by a connecting means made of a flexible material and the other end of said stator is connected to said fixed joint.

5. In an apparatus for discharging material from a hopper and including a progressing cavity pump having a rotor having a centerline, said rotor being operatively connected to a rigid stator having a centerline parallel to the rotor centerline, said rotor being connected to rotary drive means and the apparatus having means to prevent rotation of said stator, the improvement wherein said stator is connected to a fixed joint which is pivotable and has means to prevent rotation of said stator at said fixed joint whereby upon activation of the rotary drive means said rotor rotates about the rotor centerline and orbits in a conical orbit having an apex located on the rotor centerline, and said stator orbits in a conical orbit having an apex located on the stator centerline, wherein said rotor is connected to said rotary drive means through a flexible joint which is positioned above the material in the hopper.

6. An apparatus for discharging material from a hopper comprising:

a rigid stator, a rotor operatively connected to said stator, a rotor drive means operatively connected to said rotor by a first connecting means, said stator being connected at one end to said hopper by a second connecting means and at its other end to a fixed point by a third connecting means, whereby upon activation of said rotary drive means said rotor rotates within said stator and orbits about said first connecting means, and said stator only orbits about said third connecting means.

7. The apparatus of claim 6 wherein said first connecting means and said third connecting means are both positioned outside the material being discharged.

8. In an apparatus for discharging material from a hopper and including a progressing cavity pump having a screw rotor having a centerline and a rigid screw stator having a centerline parallel to the rotor centerline, said rotor being connected to rotary drive means and the apparatus having means to connect said stator to said hopper and means to prevent rotation thereof, the improvement wherein:

the means to connect said stator to said hopper is a flexible tube and the means to prevent rotation of the stator includes this flexible tube together with a pivotable joint having means to prevent rotation of said stator at said joint.

9. An apparatus for discharging material including:

a hopper having an outlet and containing the material to be discharged, a pump including an orbitable, non-rotatable rigid stator and an orbitable, rotatable rotor, said stator having a centerline and being connected at one end to the outlet of said hopper by a flexible tube and at its other end to a pivotable joint having means to prevent rotation of said stator thereabout, drive means connected to said rotor, said rotor having a centerline parallel to the stator centerline and being conncted to said drive means by a rotatable pivotable joint whereby upon activation of said drive means said rotor rotates about the rotor centerline and orbits in a conical orbit having an apex located on the rotor centerline, said stator orbits in conical orbit having an apex located on the stator centerline, and the centerlines are enclosed within said flexible tube.

10. The apparatus of claim 9 wherein said rotatable, pivotable joint connecting said drive means to said rotor and said pivotable joint to which said stator is connected are both positioned outside the material being discharged.

* * * * *